US006151824A

United States Patent [19]

Clayton

[11] Patent Number: 6,151,824

[45] Date of Patent: Nov. 28, 2000

[54] GUN HAVING VARIABLE DIRECTION OF DISCHARGE

[76] Inventor: Richard A. Clayton, 71 Humboldt St., Simi Valley, Calif. 93065

[21] Appl. No.: 08/922,228

[22] Filed: Sep. 2, 1997

[51] Int. Cl.[7] ..... A63H 33/18

[52] U.S. Cl. ..... 42/54; 124/69; 124/73; 239/265.27; 239/587.6

[58] Field of Search ..... 124/57, 59, 64, 124/65, 69, 71, 73; 89/1.34, 1.41, 126, 127; 42/54, 55; 239/265.25, 265.27, 265.29, 265.31, 587.5, 587.6

[56] References Cited

U.S. PATENT DOCUMENTS

| | | | |
|---|---|---|---|
| 819,602 | 5/1906 | Rupp | 239/587.1 |
| 927,837 | 7/1909 | Delene | 239/468 |
| 979,771 | 12/1910 | Kunzelmann | 239/587.5 |
| 1,262,004 | 4/1918 | Beachy . | |
| 1,448,587 | 3/1923 | Arntzen | 89/1.41 |
| 1,825,489 | 9/1931 | Tostenson . | |
| 2,564,058 | 8/1951 | Fletcher et al. | 239/587.2 |
| 3,994,443 | 11/1976 | Shenker | 239/587.5 |
| 4,119,152 | 10/1978 | Koyama | 239/587.2 |
| 5,188,557 | 2/1993 | Brown | 124/57 |
| 5,427,320 | 6/1995 | Mak et al. | 222/79 |

FOREIGN PATENT DOCUMENTS

| | | | |
|---|---|---|---|
| 1294819 | 4/1962 | France | 42/54 |

*Primary Examiner*—Stephen M. Johnson

[57] ABSTRACT

A gun projects matter from a discharge port, such as a barrel or nozzle, that is movably carried, so that the direction of discharge is variable with respect to the body of the gun. A manual direction controlling mechanism may be implemented for the movable discharge port, whereby the variable direction of discharge is directly controlled by a user, or an automatic direction controlling mechanism may be implemented such that the direction of the movable discharge port is automatically varied in response to the operation of a discharge actuating mechanism of the gun. Multiple discharge ports, capable of aiming in multiple directions simultaneously, may be incorporated to facilitate the projection of liquid or solid projectiles toward multiple or moving targets.

15 Claims, 7 Drawing Sheets

GUN HAVING VARIABLE DIRECTION OF DISCHARGE

BACKGROUND OF THE INVENTION

The invention relates generally to the structures of toy guns, and more particularly to such structures in which a nozzle, barrel or other projectile discharging port is movably carried to allow water, darts or other matter to be discharged in variable directions with respect to the gun.

Water guns are known in the art in which the projectile (water) is discharged from a single nozzle which is pivotally carried on the body or frame of the gun. A user may manually control the direction of discharge by rotating a knob which is affixed to the nozzle so that the knob and nozzle pivot together. No indexed or "normal" rest position is provided for the nozzle, so a user will not generally know in what direction the gun will fire without visually inspecting and adjusting the nozzle.

A toy dart gun with a pivoting single barrel is marketed by Hasbro, Inc. under the names Sneak Shot and Corner Shooter. A user may manually control the direction of discharge by rotating a separately pivoted knob, which causes the barrel to pivot via a gear train. The barrel is not biased or indexed to a rest position, and thus may be left in any position within its range of motion.

U.S. Pat. No. 4,615,488 (Sands) discloses a nozzle assembly for a water gun wherein a rotatable member may be manually positioned to align various orifices and passageways to allow water to selectably be discharged from nozzles directed toward the front, rear and side of the gun. The nozzles are fixed in their orientations so their directions of discharge cannot be varied.

SUMMARY OF THE INVENTION

The present invention provides novel constructions for toy guns wherein a projectile discharge port, such as a barrel or nozzle, may be variably aimed with respect to the gun body, and wherein the discharge port is also automatically returned to a rest position, such that when a user is not actively selecting a discharge direction, the port will return to its rest position. The rest position provides a default firing direction with respect to the body of the gun, so that a user, without visually inspecting the discharge port or observing an actual discharge, will know in what direction discharge will normally occur. This "frame of reference" aids the user in rapidly aiming the gun via movement of the gun body, or of the movable discharge port, or both.

The present invention further provides novel mechanisms which enhance the effect of incorporating a variable direction discharge port into a gun. Whereas the rotatable knobs of the prior art are useful in slowly and precisely aiming such a discharge port, such as for a surprise attack, they are cumbersome and less effective for rapid response to moving or multiple targets or the like. The present invention overcomes these problems by employing improved mechanisms for controlling motion of the discharge ports, whereby the ports may be rapidly swept through their entire range of motion, with minimal effort, while still maintaining a high degree of accuracy.

Further with respect to the problems encountered in situations involving multiple targets, the present invention provides novel structures wherein multiple discharge ports may be simultaneously aimed in different directions so that targets in different positions may be simultaneously fired upon. In a preferred embodiment, one nozzle of a water gun is fixed in the forward direction, while two movable nozzles may be swept to the sides by up to ninety degrees, one nozzle to the left and one to the right. In another embodiment, a dart gun employs two movable barrels which normally aim forward. By actuating a lever on the gun body a user may sweep the barrels, one to the right and one to the left, by equal amounts about the normal forward direction. Thus, the user can simultaneously attack two targets by aiming the gun body at an angle halfway between the targets and sweeping the barrels outward by an appropriate amount. In a third embodiment, one discharge port of a gun is fixed in the forward direction, while another port may be swept by ninety degrees to either the right or the left. In this manner, two targets may be attacked by pointing the fixed port toward one target and then aiming the swept discharge port toward a target on the right or left side.

Therefore, it is among the objectives of the present invention to provide novel, improved and more effective means and mechanisms for varying the discharge direction of toy guns through enhancements to basic structures, through the employment of multiple discharge ports, and through the cooperative engagement of variable direction discharge ports to discharge controlling or actuating mechanisms, or other mechanisms which may be employed in such guns.

BRIEF DESCRIPTION OF THE DRAWINGS

The present invention, both as to its organization and manner of operation, together with further objects and advantages thereof, may best be understood with reference to the following description, taken in conjunction with the accompanying drawings in which.

DESCRIPTION OF EXEMPLARY EMBODIMENTS

Figure 1:
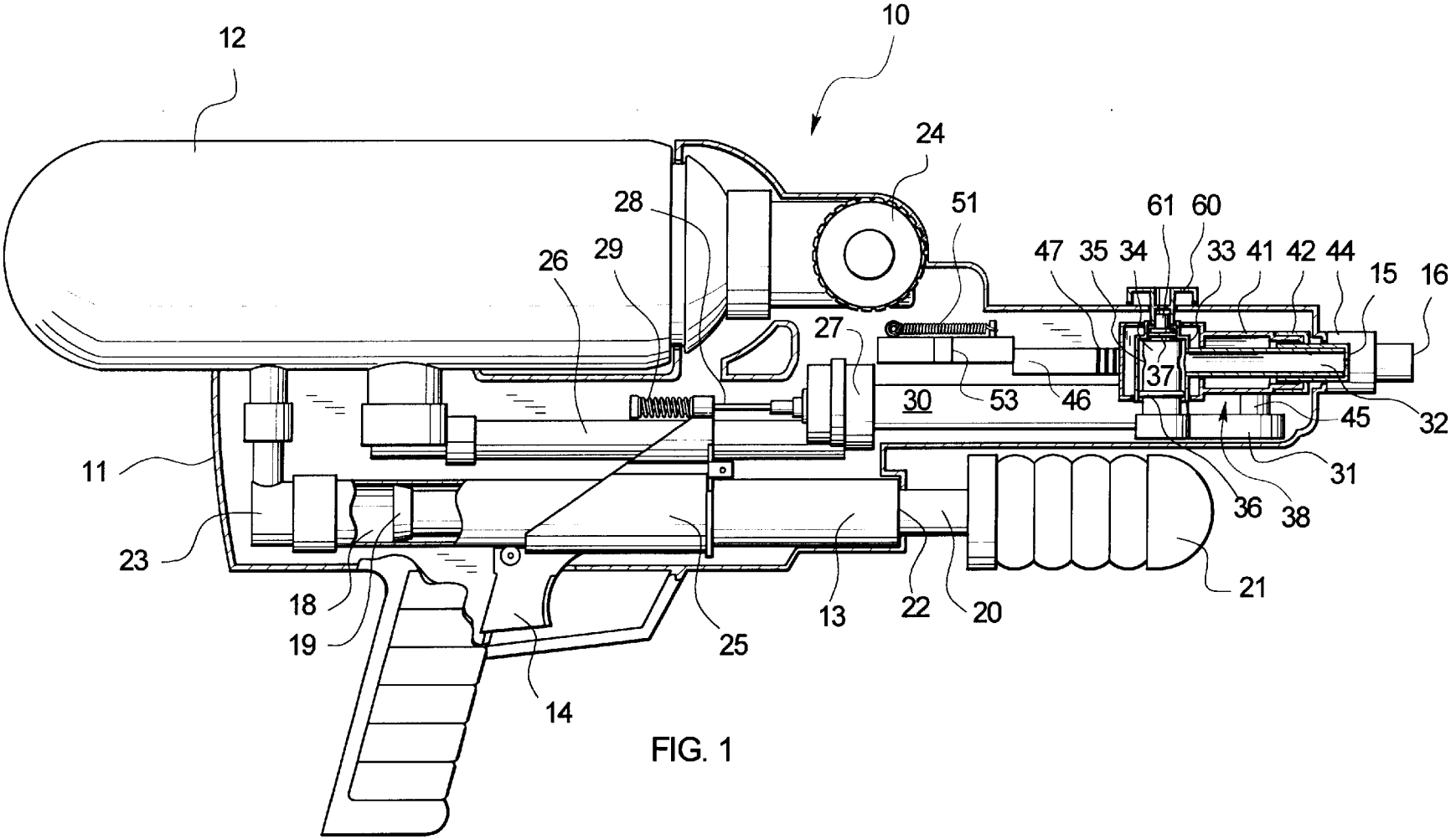
FIG. 1 is a side view, partially in section, of a novel water gun incorporating the invention.

FIGS. 1, 2, 3 and 4 depict, by way of illustration but not of limitation, a water gun employing the present invention. The water gun, indicated in the general direction of arrow 10, comprises a body or frame 11, a water tank 12, a pump 13, a trigger 14 and three nozzles 15, 16, 17. The water gun utilizes an air pressure system to discharge water as follows: Pump 13 comprises a hollow cylinder 18, within which a piston 19 is carried for movement by a plunger comprising a shaft 20 and a handle 21. As the plunger is drawn outward from the cylinder (to the right in FIG. 1), outside air is drawn into the cylinder 18 through an open end 22 of the cylinder. A one way valve 23 prevents water from being drawn from the tank 12 into the pump cylinder 18. As the plunger 20, 21 is moved back in to the cylinder, piston 19 forces air from within the cylinder, through valve 23, and into tank 12. The tank is sealed by a fill cap 24 and adapted for pressurization so that, as the pump 13 is repeatedly actuated, air pressure within the tank will become substantially elevated with respect to ambient air pressure. The trigger 14 is part of a larger trigger assembly 25 which is supported by cylinder 18 for sliding longitudinally thereupon. Trigger assembly 25 is also slidingly supported upon a tube 26 which conducts water from tank 12 to a valve 27. The trigger assembly 25 further engages (through a spring linkage 29) an actuating rod 28 connected to valve 27. When the trigger 14 is moved rearward (to the left in FIG. 1) trigger assembly 25 pulls rod 28 rearward to open valve 27, whereby operably pressurized water will flow from tube 26 through the valve and into another tube 30. As will be described in greater detail, tube 30 conducts water to a manifold 31 for distribution to three barrel assemblies 38, 39 and 40, from which water is ultimately discharged via the three nozzles 15, 16 and 17. Barrel assembly 40 is fixed in position to aim in the forward direction, while barrel assemblies 38 and 39 are attached to manifold 31 through swivel couplings so that they may be rotated outward to the right and left, respectively, of the forward direction. While the above described pressurization system is presently preferred, the novel three way discharge feature may be similarly employed with other mechanisms adapted to pressurize water in a gun.

Figure 2:
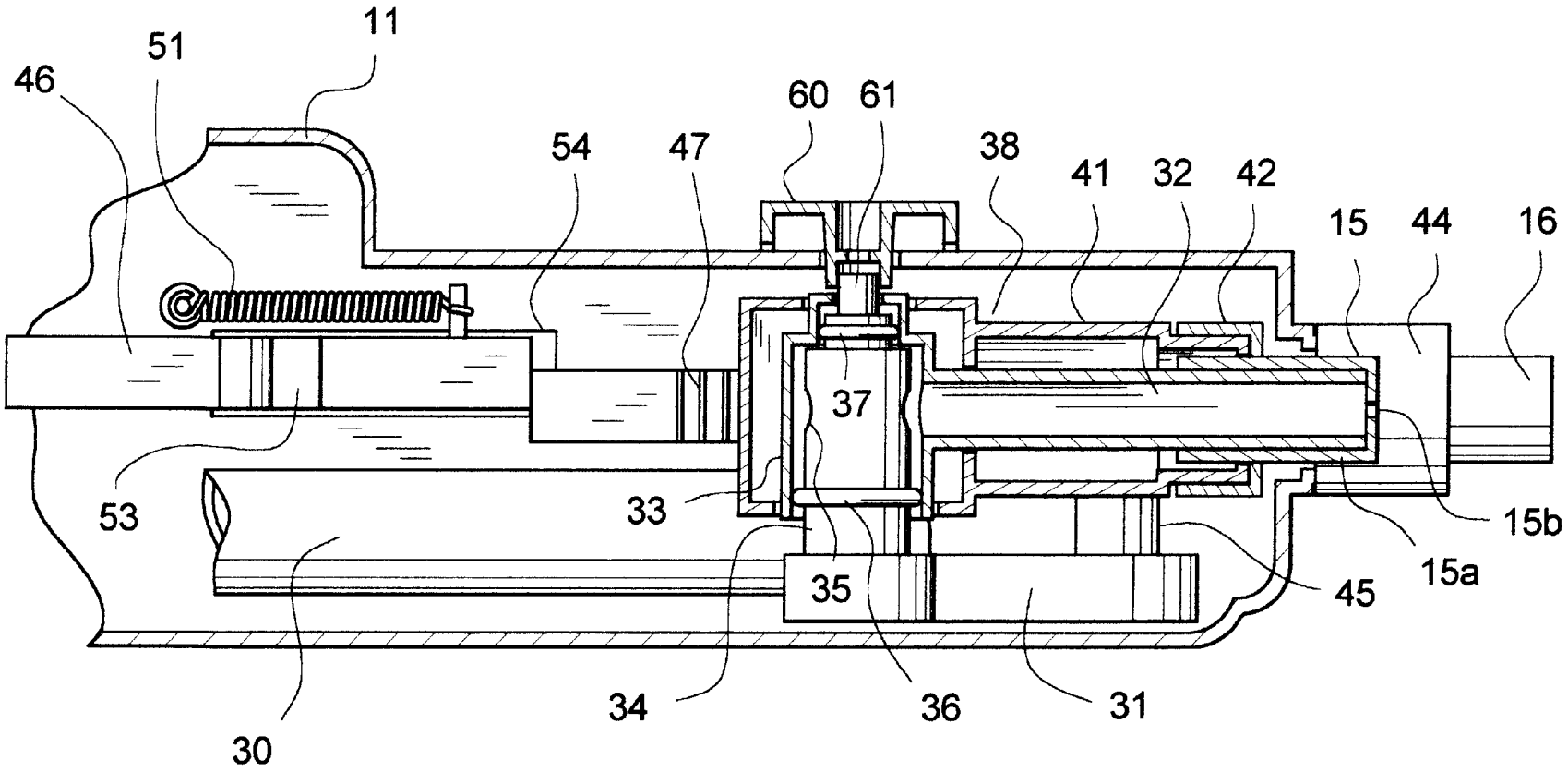
FIG. 2 is an enlargement of the nozzle structure of the water gun of FIG. 1.
Figure 3:
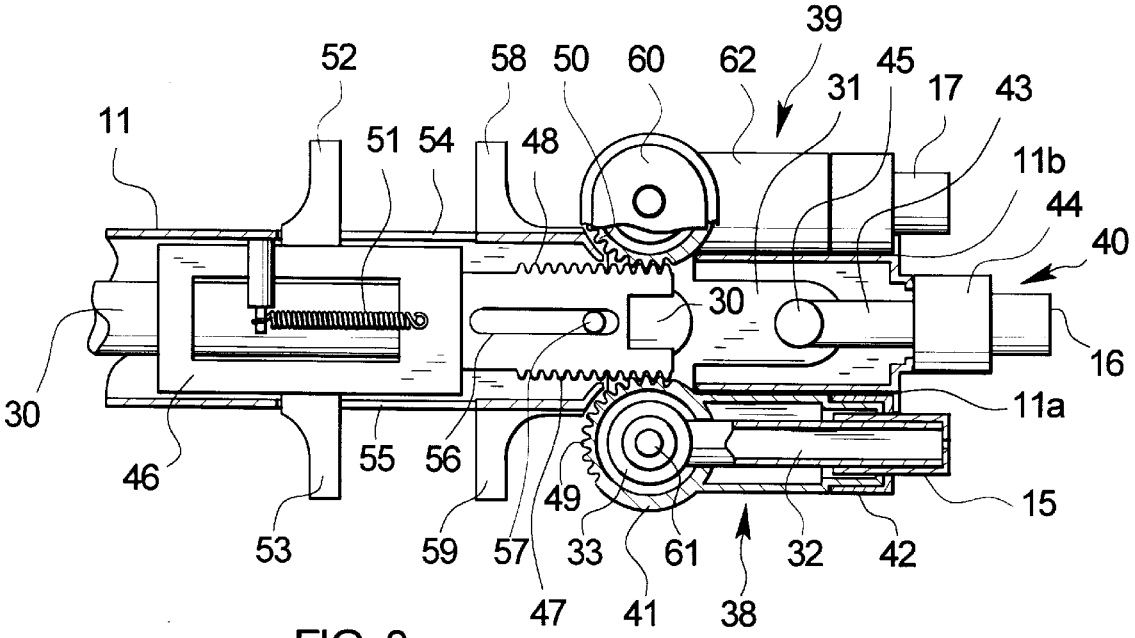
FIG. 3 is a top view, partially in section, of the nozzle structure of the water gun of FIG. 1.
Figure 4:
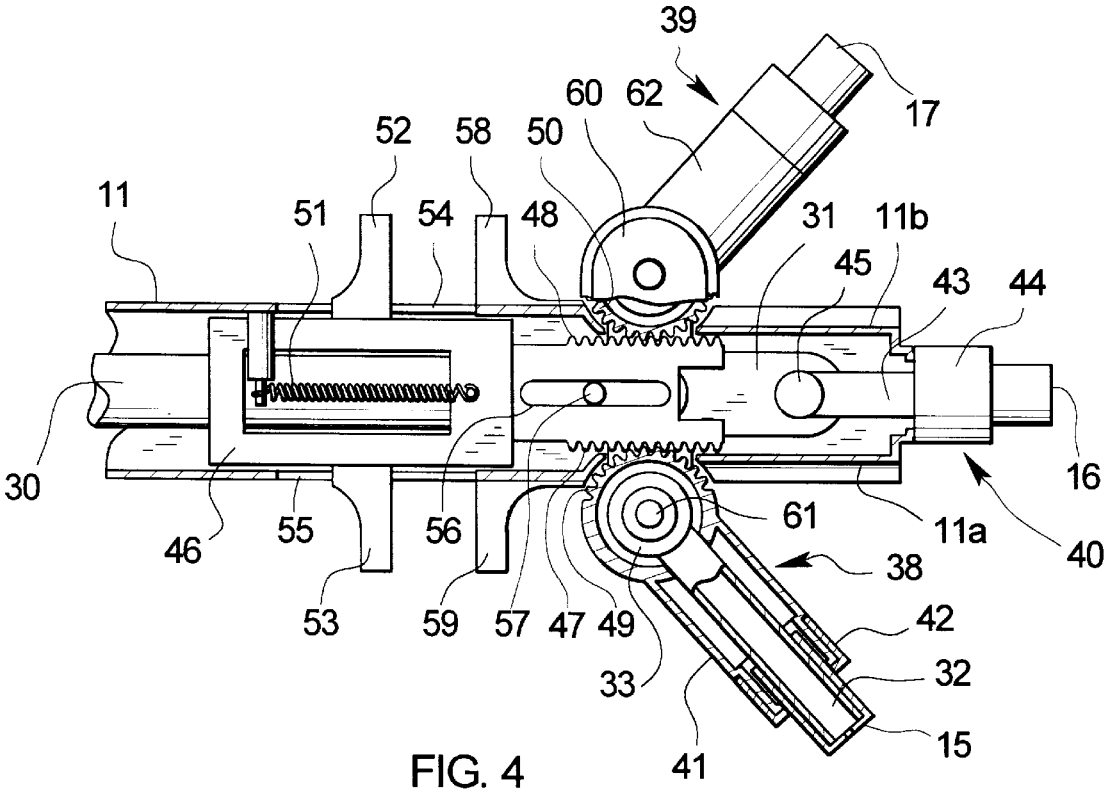
FIG. 4 depicts the nozzle structure of FIG. 3 in which two nozzles have been swept outward.

Details of the three-way nozzle and associated mechanisms may be best observed with reference to FIGS. 2, 3 and 4. Nozzle 15 is a component of barrel assembly 38, which further comprises a tube 32, a hollow cylinder 33, and a hollow outer shell 41. The tube 32 and hollow cylinder 33 are integrally formed at right angles to each other, with their interiors being in fluid communication with one another. The outer shell 41 encloses the combination of tube 32 and cylinder 33, and is of a generally similar but larger shape. A retaining cap 42 holds shell 41 in place about nozzle 15. Nozzle 15 is formed as a cylindrical cap 15*a*, having an orifice 15*b*, and is adapted to fit tightly over the forward end of tube 32. Nozzles 16 and 17 are similarly constructed.

Cylinder 33 of barrel assembly 38 is adapted to coaxially receive a cylindrical outlet member 34 of manifold 31. Water exits member 34 through a pair of orifices 35 and flows into the space between cylinder 33 and manifold member 34. This space is sealed at two ends by O-rings 36 and 37 such that operably pressurized water is forced through tube 32, to be discharged from nozzle 15. The O-rings 36, 37 also serve as bearings upon which barrel assembly 38 may be rotated. Barrel assembly 39, comprising nozzle 17, is similarly constructed. A barrel retaining cap 60 attaches to a shaft 61 on the top of manifold member 34 to keep barrel assembly 38 in place. The retaining cap 60 extends over frame 11 to likewise engage and retain the other rotating barrel assembly 39.

Nozzle 16 is a component of barrel assembly 40, which further comprises a tube 43 and a retaining cap 44. These structures may be best viewed in FIGS. 2 and 3. Nozzle 16 is held in a fixed position on frame 11 by retaining cap 44 and is permanently aimed in the forward direction. Tube 43 is connected in fluid communication with an outlet member 45 of manifold 31, whereby operably pressurized water will flow from the manifold, through tube 43, to be discharged from nozzle 16.

Barrel assemblies 38 and 39 may be simultaneously rotated by an operator via a direction controlling mechanism comprising a slidable rack 46 having two sets of gear teeth 47 and 48, which mate with teeth 49 on outer shell 41 of barrel assembly 38 and teeth 50 on outer shell 62 of barrel assembly 39, respectively. With reference to FIG. 3, it may be observed that with the rack 46 in a rearward position both barrel assemblies 38, 39 are aimed forward. A spring 51 is employed to normally bias the rack to this rearward rest position, and to thus normally bias barrels 38 and 39 to aim in the forward direction. With reference to FIG. 4, it may be observed that with the rack in a forward position the barrel assemblies 38, 39 are rotated by equal but opposite amounts from the central forward direction. In this embodiment the rack may be moved still farther forward to rotate barrel assemblies 38 and 39 outward by up to ninety degrees from their normal forward aimed positions.

It is noted that under some circumstances it might be desirable to eliminate the rack return spring 51, to allow a user to leave the barrels in set (but user variable) positions. In such a case, friction between O-rings 36 and 37 and cylinder 33 (and between corresponding components of barrel assembly 39) can be made sufficient to hold the barrels in any set position, while still allowing easy movement of the barrels 38, 39 via rack 46. However, it is also desirable that the user be able to quickly, accurately and reliably reposition barrels 38 and 39 to aim forward. To that end barrels 38 and 39 are prevented from counter-rotating beyond their forward aimed positions by engagement of outer shells 41 and 62 with members 11*a* and 11*b* of the frame. Thus the possibility of "overshooting" forward aim is eliminated and a user may reposition for forward aim simply by sliding rack 46 as far rearward as it will go.

Operator access to the rack 46 is provided by two handles 52, 53, located on two sides of the rack. Slots 54, 55 in the frame 11 allow the handles 52, 53 to extend to the exterior of the gun, and also provide bearing surfaces upon which the rack slides. A slot 56 on the forward portion of rack 46 slides about an alignment pin 57 which protrudes from the top side of tube 30. A second pair of handles 58, 59 are provided on the frame 11 in order for a user to move the rack by squeezing handles 52 and 58 (or handles 53 and 59) together between the thumb and index finger of one hand.

In summary of the above described embodiment of the invention, it is observed that the pressurization and trigger mechanisms may be actuated to discharge water from a three way nozzle assembly comprising barrels 38, 39 and 40. A user may selectively actuate a barrel positioning (or "direction controlling") mechanism by sliding a handle (52 or 53) back and forth on the frame 11. The handles 52, 53 drive a rack 46 to proportionately rotate or sweep barrels 38 and 39 through equal but opposite arcs of up to ninety degrees from the forward direction. The swept barrel assemblies 38 and 39 are preferably spring biased to automatically return to rest positions wherein they are forward aimed.

Figure 5:
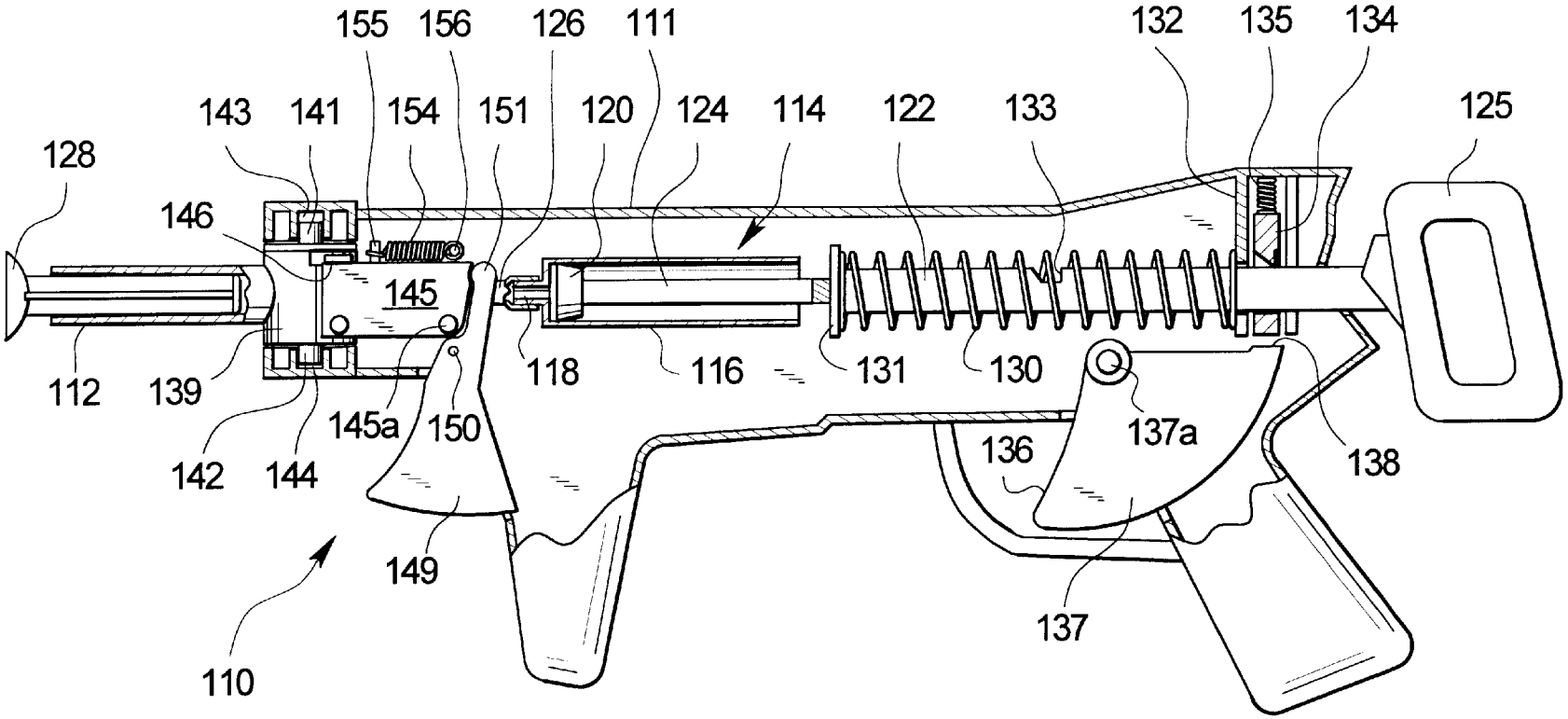
FIG. 5 is a side view, partly in section, of a novel dart gun incorporating the invention.
Figure 6:
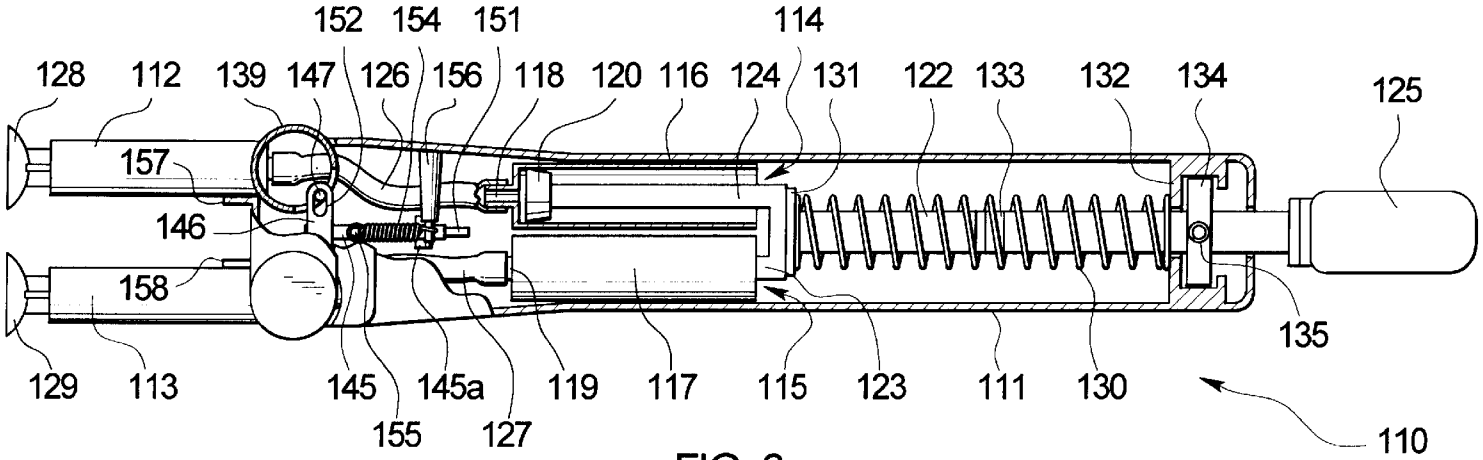
FIG. 6 is a top view, partly in section, of the dart gun of FIG. 5.
Figure 7:
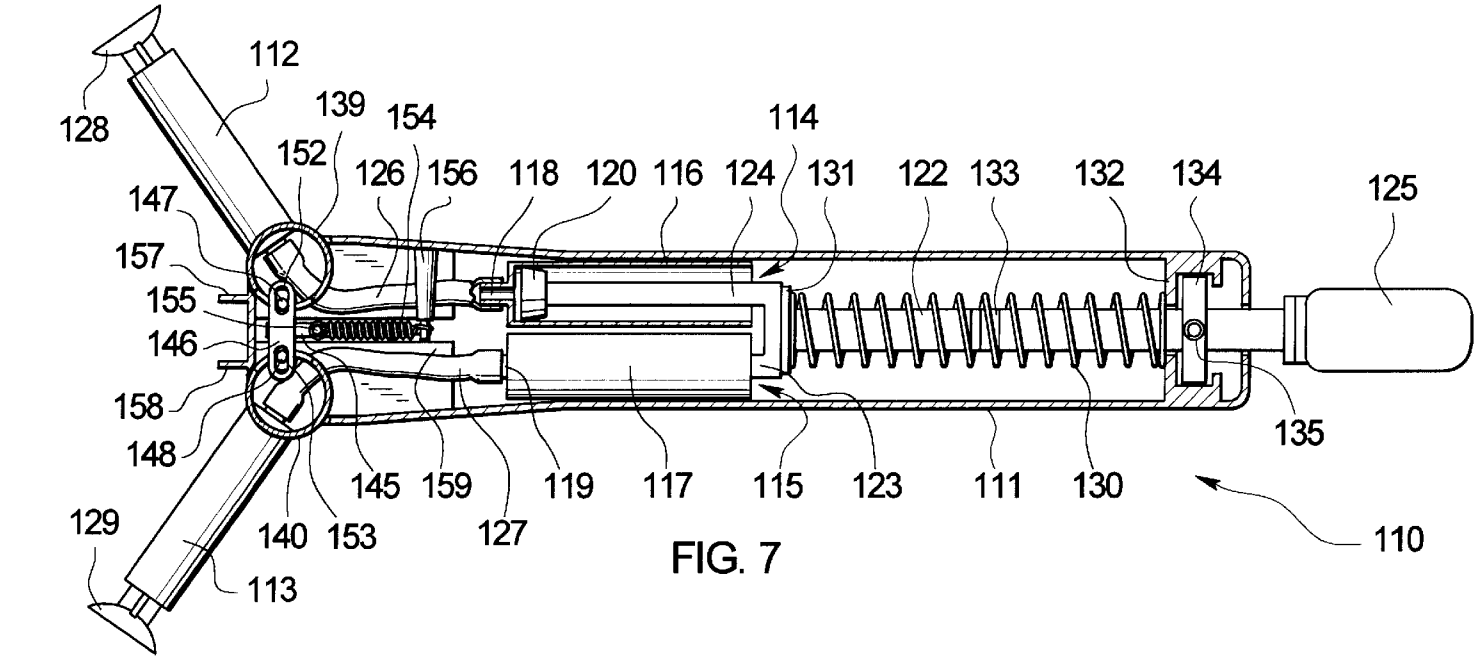
FIG. 7 is a top view of the dart gun of FIGS. 5 and 6, in which two dart barrels have been swept outward.

FIGS. 5, 6, and 7 depict a dart projecting gun that incorporates the present invention. The dart gun, indicated in the general direction of arrow 110, comprises a frame 111, two hollow barrels 112 and 113, and two air pumps 114 and 115. Each air pump comprises a cylinder 116, 117 having an air outlet 118, 119, and a piston 120. The pistons are part of a plunger assembly 122 which includes piston rods 123, 124 and a handle 125. The air outlets 118, 119 are connected to the barrels 112, 113 through flexible tubes 126, 127 so that air pressurized by the pumps 114, 115 will be conducted to the barrels 112, 113. Projectiles 128 and 129 are adapted to form generally airtight, but releasable seals with the interiors of the barrels, so that they will be ejected by the force of such pressurized air.

The dart gun is cocked and discharged as follows: A user pulls handle 125 rearward (to the right in FIGS. 5, 6, and 7) to compress a spring 130 between a bulkhead 131 of the plunger and a flange 132 of the frame. As the plunger 122 is drawn back by such action, a notch 133 becomes aligned with a latch 134. A second spring 135 biases the latch into the notch, to retain the plunger 122 in a rearward "cocked" position against the bias of spring 130. The user may release the plunger from latch 134 by pressing on the face 136 of a trigger 137, which pivots on the frame about a shaft 137*a* so that a release member 138 of the trigger pushes the latch 134 upward and out of notch 133. Spring 130 then propels the plunger 122 forward such that pistons 120 simultaneously compress air within cylinders 116 and 117. The compressed air is conducted by tubes 126 and 127 to barrels 112 and 113 to simultaneously eject projectiles 128 and 129 from the gun.

Each barrel 112, 113 comprises a mounting structure 139, 140 which is carried for rotation upon the frame 111. Referring to FIG. 5, details of this feature are shown for barrel 112, which comprises a rotatable mounting structure 139 having a pair of shafts 141, 142 which are received to pivot within sockets 143, 144 on the frame 111. The mounting components for barrel 113 are similarly constructed.

A direction control mechanism is provided to allow a user to simultaneously rotate barrels 112 and 113 to vary the directions in which they are aimed. This mechanism includes a member 145 which is movably carried upon the frame 111 to slide longitudinally on the gun 110 (i.e., parallel to a longitudinal axis of the plunger 122). Frame members 159 (ref. FIG. 7) engage protruding shafts 145*a* (ref. FIGS. 5 and 6) of the sliding member 145 to guide it through its path. The sliding member 145 includes a linkage 146 that engages a shaft 147, 148 on each of the rotatable barrel mounting structures (ref. FIGS. 6 and 7). A user operable lever 149 pivots on the frame about a shaft 150 whereby a member 151 of the lever forces sliding member 145 forward upon the frame. As sliding member 145 moves forward, linkage 146 forces shafts 147 and 148 forward, which causes barrel 112 to rotate in the clockwise direction, with respect to FIGS. 5 and 6, and causes barrel 113 to rotate an equal amount in the counter-clockwise direction. Lateral movement of shafts 147 and 148 is "lost" in slots 152, 153 of linkage 146. Depending on the degree to which the lever 149 is pivoted, the barrels 112, 113 may be variably rotated, in substantially equal magnitude and opposite direction, up to ninety degrees from the forward direction. The direction control mechanism as described above essentially "amplifies" the angular displacement of lever 149 to produce a greater angular displacement of the barrels. Thus, the user may sweep the barrels outward by ninety degrees with only about thirty degrees displacement of the lever. A spring 154 is attached at one end to a shaft 155 on the sliding member 145, and at its other end to a shaft 156 protruding from the frame 111. The spring 154 biases sliding member 145 rearward so that if the user releases lever 149, the sliding member 145 and the barrels 112, 113 will automatically return to the positions depicted in FIG. 6. Indexing stops 157, 158 on the frame prevent counter-rotation of the barrels 112, 113 beyond the forward aimed positions shown in FIG. 6. In summary of the embodiment illustrated by FIGS. 5, 6, and 7, the gun is able to simultaneously discharge darts at two targets up to 180 degrees apart, with the barrels being biased and indexed to normally both aim in the forward direction.

Figure 8:
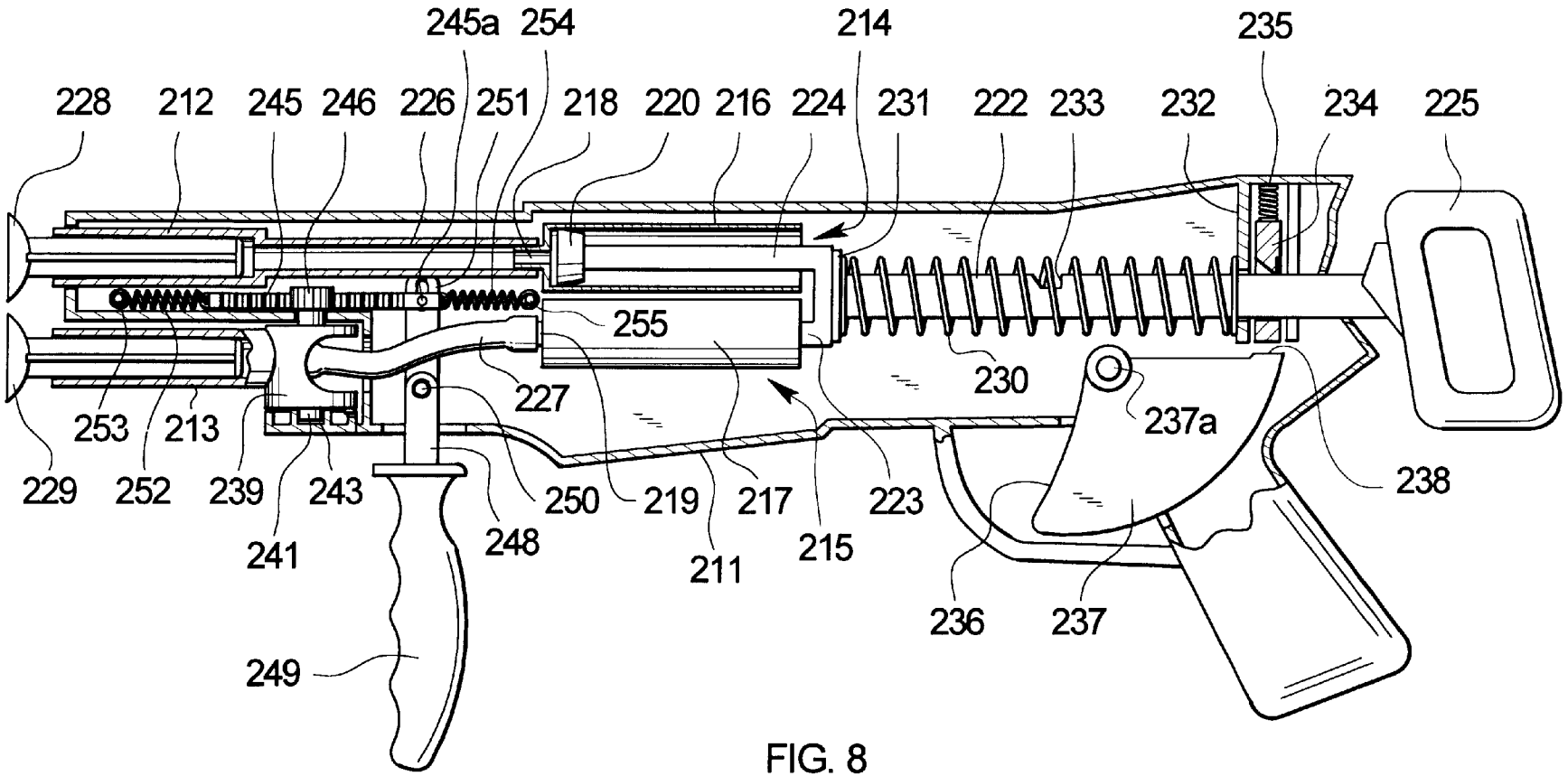
FIG. 8 is a side view, partly in section, of another novel dart gun incorporating the invention.
Figure 9:
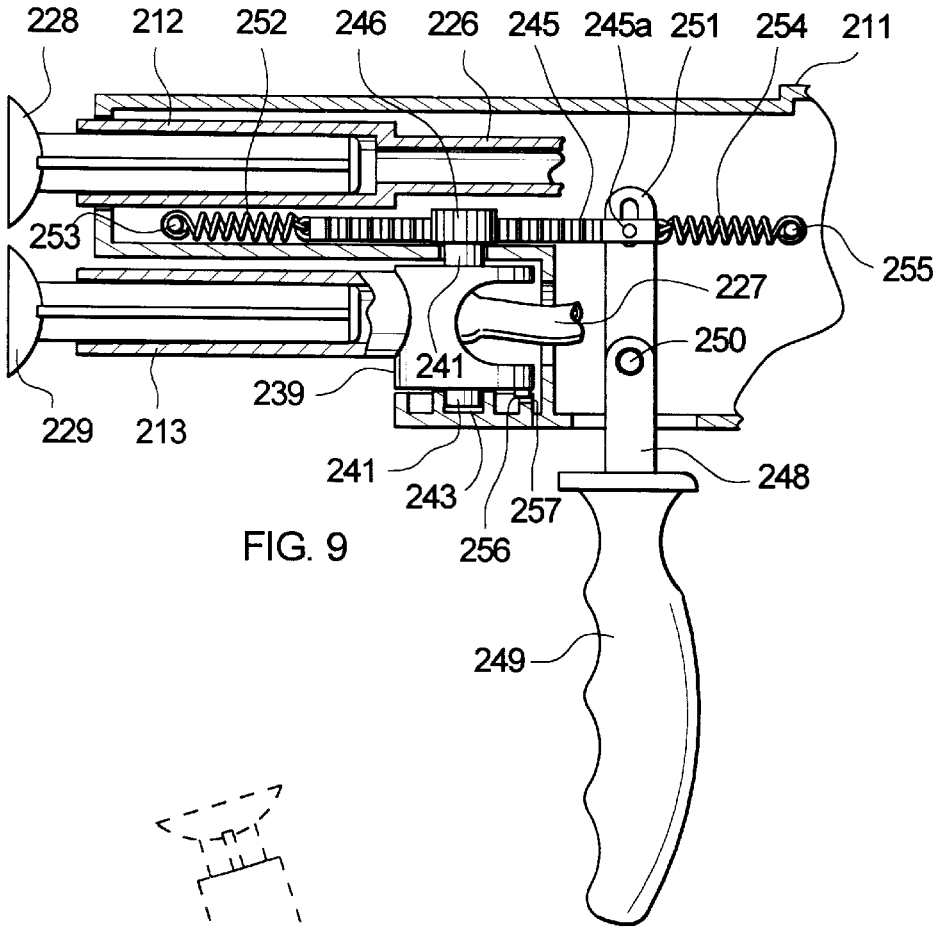
FIG. 9 is an enlargement of the barrel structure of the dart gun of FIG. 8.
Figure 10:
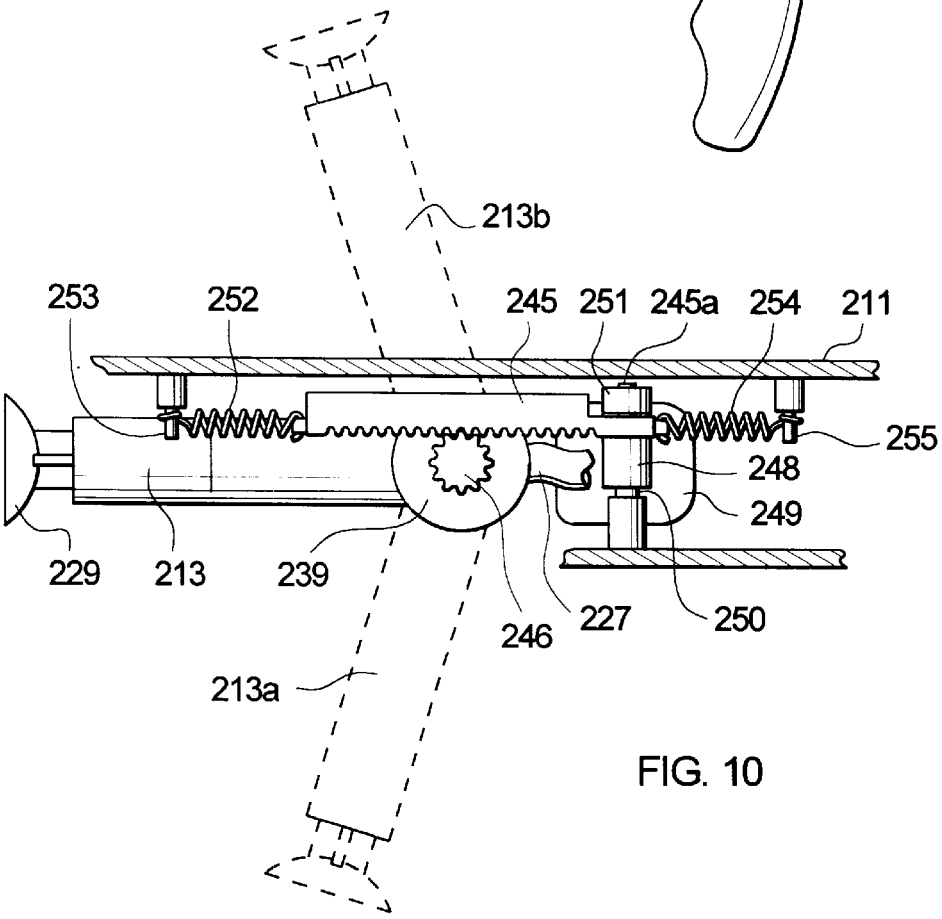
FIG. 10 is a top view, partly in section, of the barrel structure of the dart gun of FIG. 8.

FIGS. 8, 9, and 10 depict another dart gun constructed in accordance with the present invention. The dart gun comprises a frame 211, two hollow barrels 212, 213 and two air pumps 214, 215. Each air pump comprises a cylinder 216, 217 having an air outlet 218, 219, and a piston 220. The pistons are part of a plunger assembly 222 which includes piston rods 223, 224 and a handle 225. The air outlet 218 of the upper pump 214 is connected to the upper barrel 212 through a rigid tube 226 so that air pressurized by the pump 114 will be conducted to the barrel 112. The air outlet 219 of the lower pump 215 is similarly connected to the lower barrel 213, but through a flexible tube 227. Projectiles 228 and 229 are adapted to form generally airtight, but releasable seals with the interiors of the barrels, so that they will be ejected by the force of air pressurized by pumps 214 and 215.

The dart gun of FIGS. 8, 9, and 10 is cocked and discharged in the same manner as the previously described dart gun of FIGS. 5, 6, and 7. A user pulls handle 225 rearward to compress a spring 230 between a bulkhead 231 of the plunger and a flange 232 of the frame. As the plunger 222 is drawn back by such action, a notch 233 becomes aligned with a latch 234. A second spring 235 biases the latch into the notch, to retain the plunger 222 in a rearward "cocked" position against the bias of spring 230. The user may release the plunger from latch 234 by pressing on the face 236 of a trigger 237, which pivots on the frame about a shaft 237*a* so that a release member 238 of the trigger pushes the latch 234 upward and out of notch 233. Spring 230 then propels the plunger 222 forward such that pistons 220 simultaneously compress air within cylinders 216 and 217. The compressed air is conducted by tubes 226 and 227 to barrels 212 and 213 to simultaneously eject projectiles 228 and 229 from the gun.

The upper barrel 212 is held in a fixed position upon frame 211, such that it always aims in the forward direction. The lower barrel 213 comprises a mounting structure 239 which is carried for rotation upon the frame 211. Details of this feature may best be viewed with reference to FIG. 9. The rotatable mounting structure 239 comprises upper and lower shafts 241 which are received to pivot within sockets 243 on the frame 111. A control mechanism is provided to allow a user to vary the direction in which the rotatable barrel 113 is aimed. This mechanism includes a rack 245 which is movably carried upon the frame 211 to slide longitudinally on the gun (i.e., parallel to a longitudinal axis of the plunger 222). For simplicity of the figures, frame members that support the rack are not shown. The rack 245 drives a gear 246 that is mounted on the upper pivot shaft of the rotatable barrel mounting structure 239. A user operable lever 248, having a handle 249 pivots on the frame about a shaft 250 whereby a slotted upper member 251 of the lever forces rack 245, via a shaft 245*a*, forward or backward upon the frame. With reference to FIG. 10 it may be observed that as rack 245 moves forward, gear 246 and barrel 213 are forced to rotate in the counter-clockwise direction. When rack 245 moves rearward, gear 246 and barrel 213 are forced to rotate in the clockwise direction. Depending on the direction and degree to which the lever 248 is pivoted, the barrel 213 may be variably rotated to either side (as indicated by dashed lines 213*a*, 213*b* in FIG. 10), up to ninety degrees from the forward direction. A pair of springs 252, 254, attached to the frame 211 at shafts 253 and 255, are adapted to bias the rack 245 to a central position corresponding to barrel 213 being aimed in the forward direction. A downwardly protruding tab 256 on the rotatable barrel mounting structure 239 is adapted to engage an indexing slot 257 on the frame 211 when barrel 213 is in the forward aimed position, such that the barrel may be positively aligned in this rest position. A small amount of extra force on handle 249 is required to move the barrel from the rest position.

In summary of the embodiment illustrated by FIGS. 8, 9, and 10, the gun is able to simultaneously discharge darts at two targets up to 90 degrees apart, with one barrel being permanently aimed in the forward direction, and the other barrel being variably aimable by plus or minus ninety degrees about forward. The variably aimed barrel is biased and indexed to normally aim in the forward direction.

It is noted that the discharge direction controlling mechanisms and associated user interfaces from any of the previously described embodiments may be adapted for use with features found in the other embodiments.

While particular embodiments of the present invention have been shown and described, it will be obvious to those skilled in the art that changes and modifications may be made without departing from this invention in its broader aspects and therefore the aim in the appended claims is to cover such modifications which fall within the true spirit and scope of this invention.

What is claimed is:

1. A toy gun comprising a frame and a plurality of discharge ports, said gun adapted to be carried by a user thereof during operation of said gun;

each of said ports adapted for directionally projecting matter from said gun;

at least two said discharge ports being movably carried on said frame whereby the directions in which said movable ports discharge matter may be varied with respect to said frame;

wherein said two movable discharge ports are cooperatively engaged such that operative motion of one of said movable ports will be matched by motion of the other of said movable ports, in substantially equal magnitude and opposite direction.

2. A toy gun comprising a frame and a plurality of discharge ports, said gun adapted to be carried by a user thereof during operation of said gun;

each of said ports adapted for directionally projecting matter from said gun;

at least two said discharge ports being movably carried on said frame whereby the directions in which said movable ports discharge matter may be varied with respect to said frame;

said gun further comprising a user operable mechanism for controlling the directions in which said movable discharge ports are aimed;

said direction controlling mechanism adapted to simultaneously vary the directions of said two movable discharge ports such that said two movable discharge ports may be swept in unison through paths of substantially equal distance in opposite directions.

3. A toy gun as set forth in claim 2 wherein said two movable discharge ports are biased to normally aim in a substantially common direction.

4. The invention of claim 2 comprising a liquid pressurizing mechanism adapted to provide liquid under pressure to said ports whereby said liquid may be discharged therefrom.

5. A toy gun as set forth in claim 2 including a discharge port held in a fixed position on said frame.

6. A toy gun as set forth in claim 5 wherein said two movable discharge ports are biased to normally aim in substantially the same direction as said fixed port.

7. A toy gun comprising a frame and a plurality of discharge ports, said gun adapted to be carried by a user thereof during operation of said gun;

each of said ports adapted for directionally projecting matter from said gun;

at least one of said discharge ports held in a fixed position on said frame;

at least one of said discharge ports movably carried on said frame whereby the direction in which said movable port discharges matter may be varied with respect to said frame;

said movable discharge port biased to normally aim in substantially the same direction as said fixed port.

8. A toy gun, generally adapted for use by an individual operator, comprising a frame, a plurality of discharge ports and a mechanism adapted to employ compressed air for the discharge of matter from said discharge ports;

each of said ports adapted for directionally projecting matter from said gun;

at least two of said discharge ports being movably carried on said frame whereby the directions in which said movable ports discharge matter may be widely varied with respect to said frame;

said two movable discharge ports being cooperatively engaged such that operative motion of one of said movable ports will be matched by motion of the other of said movable ports, in substantially equal magnitude and opposite direction.

9. A toy gun, generally adapted for use by an individual operator, comprising a frame, a plurality of discharge ports and a mechanism adapted to employ compressed air for the discharge of matter from said discharge ports;

each of said ports adapted for directionally projecting matter from said gun;

at least two of said discharge ports being movably carried on said frame whereby the directions in which said movable ports discharge matter may be widely varied with respect to said frame;

said gun further comprising a user operable mechanism for controlling the directions in which said movable discharge ports are aimed;

said direction controlling mechanism adapted to simultaneously vary the directions of said two movably carried discharge ports such that said two movably carried discharge ports may be swept in unison through paths of substantially equal distance in opposite directions.

10. A toy gun as set forth in claim 9 wherein said two movable discharge ports are biased to normally aim in a substantially common direction.

11. A toy gun as set forth in claim 9 including a discharge port held in a fixed position on said frame.

12. A toy gun as set forth in claim 11 wherein said two movable discharge ports are biased to normally aim in substantially the same direction as said fixed port.

13. A toy gun as set forth in claim 11 wherein said direction controlling mechanism and said movable ports are adapted to allow said movable ports to be simultaneously aimed in substantially the same direction as said fixed port.

14. A toy gun, generally adapted for use by an individual operator, comprising a frame, a plurality of discharge ports and a mechanism adapted to employ compressed air for the discharge of matter from said discharge ports;

each of said ports adapted for directionally projecting matter from said gun;

at least one of said discharge ports held in a fixed position on said frame;

at least one of said discharge ports being movably carried on said frame whereby the direction in which said movable port discharges matter may be widely varied with respect to said frame;

said movable discharge port biased to normally aim in substantially the same direction as said fixed port.

15. A toy gun, generally adapted for use by an individual operator, comprising a frame, a plurality of discharge ports and a mechanism adapted to employ compressed air for the discharge of matter from said discharge ports;

each of said ports adapted for directionally projecting matter from said gun;

at least one of said discharge ports being movably carried on said frame whereby the direction in which said movable port discharges matter may be widely varied with respect to said frame;

said toy gun further comprising a reservoir for holding a liquid, means for conducting said liquid from said reservoir to said discharge ports, and a trigger mechanism for causing said liquid to flow from said reservoir to said discharge ports under force of air from said compressed air mechanism.

* * * * *